US011785374B2

(12) United States Patent
Lastrucci

(10) Patent No.: US 11,785,374 B2
(45) Date of Patent: Oct. 10, 2023

(54) ACOUSTIC DEVICE

(71) Applicant: POWERSOFT S.P.A., Scandicci (IT)

(72) Inventor: Claudio Lastrucci, Lastra a Signa (IT)

(73) Assignee: POWERSOFT S.P.A., Scandicci (IT)

( * ) Notice: Subject to any disclaimer, the term of this patent is extended or adjusted under 35 U.S.C. 154(b) by 0 days.

(21) Appl. No.: 17/582,281

(22) Filed: Jan. 24, 2022

(65) Prior Publication Data

US 2022/0240003 A1 Jul. 28, 2022

(30) Foreign Application Priority Data

Jan. 26, 2021 (IT) ..... 102021000001487

(51) Int. Cl.
*H04R 1/28* (2006.01)
*H04R 19/02* (2006.01)

(52) U.S. Cl.
CPC ..... *H04R 1/2834* (2013.01); *H04R 19/02* (2013.01)

(58) Field of Classification Search
CPC ..... H04R 1/28; H04R 1/2807; H04R 1/2815; H04R 1/2819; H04R 1/283
USPC ..... 381/349
See application file for complete search history.

(56) References Cited

U.S. PATENT DOCUMENTS 7,158,648 B2 1/2007 Butters et al.
9,426,548 B2 8/2016 Rayner et al.
9,571,934 B2 2/2017 Stabile
2001/0024508 A1 9/2001 Croft
2004/0252859 A1* 12/2004 Saiki ..... H04R 1/2819 381/345
2005/0013459 A1* 1/2005 Maekawa ..... B60R 11/0217 381/349
2007/0092096 A1* 4/2007 Litovsky ..... H04R 1/2834 381/349
2014/0064539 A1 3/2014 Link et al.
2021/0258668 A1* 8/2021 Lu ..... H04R 7/12

FOREIGN PATENT DOCUMENTS

CN 204090070 U 1/2015

OTHER PUBLICATIONS

Search Report issued in Italian Patent Application No. 202100001487.

* cited by examiner

*Primary Examiner* — Suhan Ni
(74) *Attorney, Agent, or Firm* — United IP Counselors, LLC

(57) ABSTRACT

An acoustic device (1), comprises: a container (2); a passive resonator, including a suspension (3) connected to the container (2) and a radiator (4) connected to the suspension (3), where the suspension (3) is configured to allow the radiator (4) to vibrate relative to the container (2), a structure (5) having at least a first connecting point (51), where it is connected to the radiator (4), and a second connecting point (52), where it is connected to the container (2), the structure (5) being movable alternately between a first position and a second position, responsive to a vibration of the radiator (4); one or more masses (61, 62), spaced from the radiator (4) and associated with the vibrating structure (5).

20 Claims, 11 Drawing Sheets

ACOUSTIC DEVICE

TECHNICAL FIELD

This invention relates to an acoustic device. This invention also relates to a method for extending the low frequency response of a loudspeaker. The loudspeaker may form part of a cabinet (or loudspeaker box).

BACKGROUND

Known in the prior art in the field of acoustic devices are passive resonators (or radiators) comprising vibrating radiators, which are associated with loudspeakers or cabinets by suitable suspensions. The function of the passive resonators is to extend the response of the loudspeakers, or cabinets, at low frequencies. Examples of such acoustic devices are described in the following patent documents: U.S. Pat. No. 9,571,934B2, U.S. Pat. No. 7,158,648, US2001/024508A1, CN204090070U and U.S. Pat. No. 9,426,548B2.

In the prior art acoustic devices, the efficiency of the loudspeaker at certain frequencies (typically low frequencies) may, in some cases, need to be improved; usually, this is done by increasing the weight of the passive resonators. As a result, the radiators are very heavy. This in turn creates a problem of mechanical vibration transmitted from the passive resonators to the cabinet; another problem concerns the suspensions which, because they are highly compliant, tend to yield under the weight of the passive resonator and, over time, lose their original shape.

In the prior art devices, minimizing the mechanical vibration transmitted from the passive resonators to the cabinet often requires mounting a pair of passive resonators on two opposite sides of the cabinet so as to achieve inertial balance. This is not possible, however, where the sound has to be emitted only on one side of the cabinet, so that, for example, the cabinet can be mounted on a wall.

Conversely, a mechanical vibration transmitted from the radiator to the container (that is, to the cabinet) of the loudspeaker may, in other cases, have to be amplified in order to obtain certain acoustic and/or tactile effects.

Patent document US2014/064539A1 discloses a speaker wherein one or more masses are provided internally to the cabinet and connected mechanically to the passive resonator, with the attempt to reduce vibrations. However, this solution is disadvantageous because it introduces imbalances that may, on their turn, generate noise or damage to the structure of the speaker.

BRIEF SUMMARY

This disclosure has for an aim to provide an acoustic device and a method for extending the low frequency response of a loudspeaker to overcome at least one the above mentioned disadvantages of the prior art.

This aim is fully achieved by the acoustic device and method of this disclosure as characterized in the appended claims.

According to one aspect of it, this disclosure relates to an acoustic device. The acoustic device comprises a container (or frame, or enclosure). By container is meant a box-shaped body that delimits a space inside it. The acoustic device also comprises a passive resonator. The passive resonator includes a suspension, connected to the container, and a radiator (or vibrating diaphragm), connected to the suspension. By radiator is meant a rigid element that can move relative to the container. More specifically, the radiator is surrounded by the suspension. The suspension is configured to allow the radiator to oscillate, or vibrate, relative to the container. More specifically, the suspension is compliant, that is to say, elastic.

The acoustic device also comprises a structure that has a first connecting point, where it is connected to the radiator, and a second connecting point, where it is connected to the container. The structure is movable alternately between a first position and a second position, responsive to a vibration of the radiator. More specifically, in a preferred embodiment, the structure is fixed to the radiator at the first connecting point and to the container at the second connecting point and is deformable so it can move between the first position and the second position. In another embodiment, the structure may be connected movably to the radiator at the first connecting point and to the container at the second connecting point, and it may be rigid.

The acoustic device also comprises one or more masses, spaced from the radiator and associated with the vibrating structure, so that a movement of the vibrating structure between the first position and the second position causes a corresponding movement of the one or more masses.

The movement of the one or more masses may act as a counterweight to the movement of the radiator, thus fulfilling a balancing function useful for counteracting a mechanical vibration transmitted from the radiator to the container. The movement by rotation about the connecting points, and also by translation, approximates a linear movement, by small angles of rotation about the connecting points. This may be useful to avoid overloading the suspensions and, at the same time, to make a system that is sufficiently light but does not have unwanted vibration. This solution also has the advantage of making it possible to make an acoustic device which is very compact but which may nevertheless include a passive resonator of large size and mass (hence having a wide range response at low frequencies). This solution also has the advantage of making it possible to make an acoustic device which is inertially balanced although not geometrically symmetrical (in effect, it may have a passive resonator on one side only).

Alternatively, the movement of the one or more masses may further unbalance the system, thus amplifying a mechanical vibration transmitted from the radiator to the container. This is useful for creating certain sound and vibratory effects, for example, in cinema and gaming applications, where the emission of sound is also associated with vibration.

In an embodiment, the structure is made from or includes a deformable elastic material. In this case, the structure is elastically deformable. Preferably, the structure is elastically deformable from the first to the second position, responsive to a force applied by the radiator and, in the absence of forces applied by the radiator, is positioned at the first position. With the expression "the structure is elastically deformable" it is meant here and in the remaining part of the document that the structure as a whole can be moved, through elastic deformation of at least a portion of the structure, from the first to the second position; wherein one or more points or part of the structure may remain undeformed during such a movement.

In one example, the structure includes a compliant mechanism. By compliant mechanism is meant a flexible mechanism which achieves transmission of force and movement through elastic deformation of the box-shaped body. The compliant mechanism may include a material such as polypropylene (PP), polyethylene (PE) or other material which, within defined conditions of mechanical stress, allows withstanding a particularly high (practically infinite) number of deformation cycles. The compliant mechanism is formed preferably (at least partly) of a homogeneous material; for example, the compliant mechanism might be made using a combination of different materials; for example, it might include a first part made from a deformable material and a second, rigid part (that is, made from a rigid material); in this context, the first, deformable part is used to make the connecting parts, while the second, rigid part is used to make the vibrating structure. The compliant mechanism is elastically deformable and allows the first connecting point and the second connecting point to move in rotation and translation relative to each other.

Instead of the compliant mechanism, a structure of another kind such as, for example, a sliding system (such as brass bushings) or a rolling bearing system, might be provided. In an example embodiment, the rolling elements might be provided with a static preload to prevent slack and friction.

Preferably, the structure is movable between the first position and the second position with a roto-translational movement about the first and/or the second connecting point. With the expression "roto-translational movement", it is meant that the movement includes both a rotational component and a translational component; in other words, it is a combination of a rotation movement and a translation movement. That way, the structure performs the function of a lever or mechanism between the radiator and the one or more masses.

In one example, the acoustic device comprises a first mass and a second mass. The structure has a third connecting point, where it is connected (specifically, fixed) to the container. Preferably, the first and the second mass are symmetrical about the first (or second) connecting point; preferably, the masses are symmetric with respect to the longitudinal axis along which the radiator vibrates. That way, when the radiator moves, the acoustic device is not subject to a rotating moment and is thus more balanced.

In one preferred example, the structure is configured for transforming a translational movement of the radiator along a longitudinal axis in a (purely) translational movement of the mass (or mases) along a longitudinal orientation, in opposite direction with respect to the movement of the radiator. In other words, the structure is configured for generating, responsive to a translational movement of the radiator, a purely translational movement of one or more mases. If a single mass is provided, that mass moves along the same longitudinal axis along which the radiator moves. If two or more masses are provided, they move along respective axes which are parallel to the longitudinal axis and are arranged according to an axial symmetry with respect to the longitudinal axis.

The structure may be elongated along a transverse direction. Preferably, the acoustic device is shaped symmetrically with respect to the longitudinal axis (and the passive radiator has a circular shape). In an embodiment, the first connecting point, the second connecting point and the third connecting point are aligned along the transverse direction; the second connecting point is interposed between the first and the third connecting point. The first mass and the second mass are disposed mirror symmetrically to each other about the second connecting point. More specifically, the first connecting point is interposed, along the transverse direction, between the first mass and the second connecting point; the second connecting point is interposed, along the transverse direction, between the second mass and the third connecting point.

In an embodiment, the structure is configured to move from the first position to the second position in response to a movement of the radiator towards the second connecting point, thereby causing a movement of the one or more masses towards the radiator. In other words, the structure is configured to move from the first position to the second position in response to a longitudinal movement of the radiator in a first direction, thereby causing a movement of the one or more masses along a path that includes a longitudinal component in a second direction, opposite to the first direction. In this embodiment, the structure and the one or more masses perform the function of balancing, that is to say, of counteracting the mechanical vibration transmitted from the radiator to the container. Thus, the mass of the loudspeakers can be used as a mass integrated in the radiator of the passive resonator. This improves constructional simplicity.

In another embodiment, the structure is configured to move from the first position to the second position in response to a movement of the radiator towards the second connecting point, thereby causing a movement of the one or more masses towards the radiator. In other words, the structure is configured to move from the first position to the second position in response to a longitudinal movement of the radiator in a first direction, thereby causing a movement of the one or more masses along a path that includes a longitudinal component in the first direction. In this embodiment, the structure and the one or more masses perform the function of unbalancing, that is to say, of amplifying the mechanical vibration transmitted from the radiator to the container.

The container has a first side, where the suspension is connected (hence where the radiator is located) and a second side, opposite the first side. The second connecting point is on the second side. Preferably, the second side is without passive resonators. Thus, the second side may be mounted to a wall or a ceiling.

Preferably, the container defines an internal space and the structure is positioned in the internal space. The one or more masses are also positioned in the internal space. In other embodiments, the structure and the one or more masses might be positioned outside the internal space.

In un example embodiment, the device also comprises a loudspeaker. The loudspeaker includes a diaphragm and an electric actuator to move the diaphragm. The vibration of the diaphragm creates a pressure disturbance inside the internal space of the device; this disturbance in turn causes the radiator of the passive resonator to vibrate. Preferably, at least part of the loudspeaker is positioned in the internal space. Thus, the internal space is delimited by the container, by the passive resonator and (as the case may be) by the loudspeaker.

In an embodiment, the loudspeaker is connected to the passive resonator and is movable together with the radiator. More specifically, inside it, the radiator of the passive resonator, has a hole in which the loudspeaker is positioned (fixed). This solution further improves the compactness of the device.

This disclosure also provides a method for extending the low frequency response of a loudspeaker.

The method comprises a step of preparing an acoustic device. The acoustic device comprises a container; the container defines an internal space. The acoustic device comprises the loudspeaker. At least part of the loudspeaker is positioned in the internal space. In one example, the motor that moves the loudspeaker is positioned in the internal space. The acoustic device comprises a passive resonator, including a suspension that is connected to the container, and a radiator that is connected to the suspension to vibrate relative to the container. The electric actuator moves the diaphragm of the loudspeaker, causing the air inside the internal space to vibrate, which in turn moves the radiator of the passive resonator. The method comprises a step of transmitting movement from the radiator to one or more masses positioned inside the internal space, to counteract or amplify a mechanical vibration transmitted from the radiator to the container.

In one example, the loudspeaker includes a structure. The one or more masses are associated to the structure. The structure has at least a first connecting point, where it is connected to the radiator, and a second connecting point, where it is connected to the container. The structure moves alternately between a first position and a second position, responsive to a vibration of the radiator. The structure is configured for moving the one or more masses in a predetermined direction, which is preferably parallel to the direction along which the radiator moves. Hence, at a predetermined first (translational) movement of the radiator of a first stroke, it corresponds (according to the configuration of the structure) a predetermined second (translational) movement of the one or more masses. Preferably, the movement of the radiator and the movement of the masses occur along the same axis or parallel axes.

In order to counteract the mechanical vibration transmitted by the vibrating radiator to the container, the structure is configured so that the movement of the masses responsive to the movement of the radiator occur in opposite direction with respect to the movement of the radiator. The stroke of the radiator and the corresponding stroke of the mass (or equivalent mass resulting from the plurality of masses) may be the same or different, according to the ratio between the mass of the radiator and the mass of the (equivalent mass); for example, if the mass has larger mass than the radiator, the stroke of the radiator is smaller than the corresponding stroke of the mass.

In order to amplify the mechanical vibration transmitted by the vibrating radiator to the container, the structure may for example be configured so that the movement of the masses responsive to the movement of the radiator occur in concurrent direction with respect to the movement of the radiator.

This disclosure also provides a method for extending the low frequency response of a loudspeaker of a loudspeaker cabinet (or loudspeaker box).

The method comprises a step of vibrating the diaphragm of the loudspeaker to generate sound waves in an internal space. Preferably, at least part of the loudspeaker is positioned in an internal space of the cabinet. The method comprises a step of vibrating (or oscillating) a radiator of a passive resonator included in the cabinet. More specifically, the vibration of the loudspeaker diaphragm causes the radiator of the passive resonator to vibrate. The method comprises a step of moving the one or more masses with oscillating motion, in response to the movement of the radiator, so as to counteract or amplify a mechanical vibration transmitted to the container by the oscillation of the radiator.

It should be noted that in at least one embodiment, this invention provides a "passive resonator" that is self-consistent, that is to say, installable in any loudspeaker cabinet, in the same way as the loudspeaker is installed, thus fulfilling a mechanical vibration balancing function.

BRIEF DESCRIPTION OF THE DRAWING FIGURES

These and other features will become more apparent from the following description of a preferred embodiment, illustrated by way of non-limiting example in the accompanying drawings, in which:

FIG. 1A schematically illustrates an acoustic device according to this disclosure, provided with a container, a radiator, a structure and a mass, wherein the structure and the mass are configured to counteract a mechanical vibration transmitted from the radiator to the container;

FIG. 1B schematically illustrates a variant embodiment of the acoustic device of FIG. 1A;

FIG. 1C schematically illustrates an acoustic device according to this disclosure, provided with a container, a radiator, a structure and a mass, wherein the structure and the mass are configured to amplify a mechanical vibration transmitted from the radiator to the container;

FIGS. 1D, 1E, 1F, 1G, 1H and 11 schematically illustrate an acoustic device according to further embodiments of this invention;

DETAILED DESCRIPTION

Figure 1A:
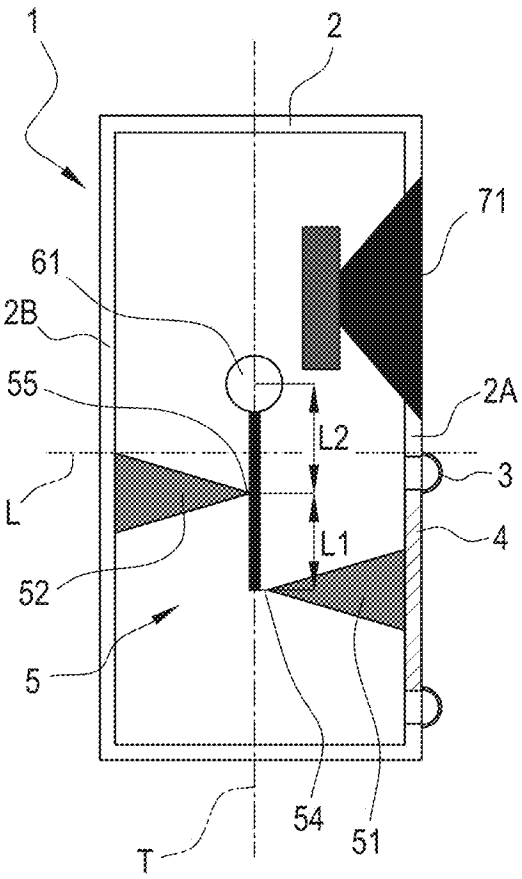

With reference to this disclosure, the numeral 1 denotes an acoustic device.

With reference to this disclosure, the numeral 1 denotes a balanced, passive radiator acoustic device. The acoustic device 1 comprises a container 2. In an embodiment in which the device constitutes a self-consistent passive resonator intended for mounting in a cabinet, the container 2 constitutes a mounting frame, that is to say, a structure which, thanks to the flanged mounting, transmits the constraining forces to the cabinet in which the device is operatively mounted.

The acoustic device 1 comprises a passive resonator, comprising a suspension 3 and a radiator (or vibrating diaphragm) 4. The radiator 4 is a rigid, oscillating (vibrating) element adapted to displace a quantity of air during (or by the effect of) its movement.

The acoustic device 1 may also comprise a loudspeaker 71. The passive resonator is positioned on a first side 2A of the container 2. The container 2 also has a second side 2B, opposite the first side. The container 2, the passive resonator and, where provided, the loudspeaker 71 delimit a closed space.

When the loudspeaker 71 is active, it causes the air (or other gas) to vibrate inside the closed space; the vibrating air causes the radiator 4 of the passive resonator to oscillate, that is, to resonate, that is to say, it causes it to move with reciprocating motion relative to the container 2; this movement is made possible by the compliance of the suspension 3. The radiator 4 moves relatively along a longitudinal direction L.

Figure 1B:
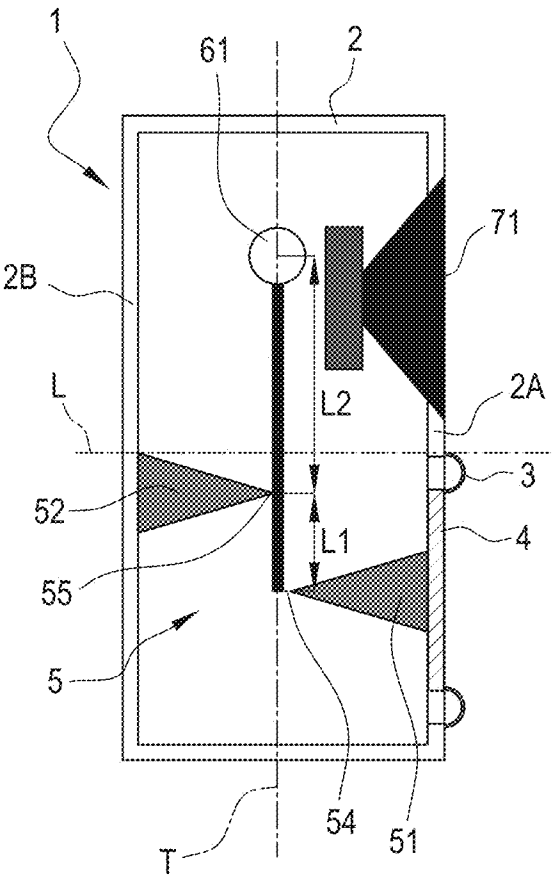
Figure 1C:
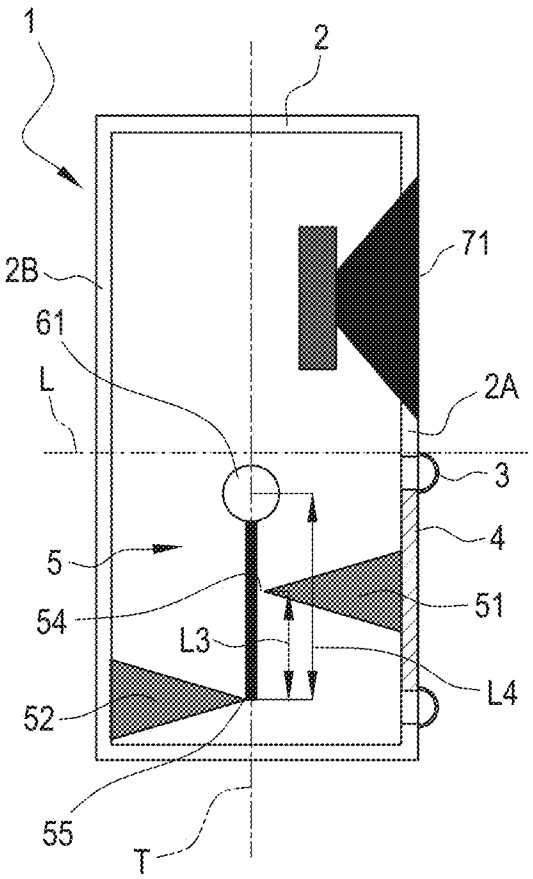
Figure 1E:
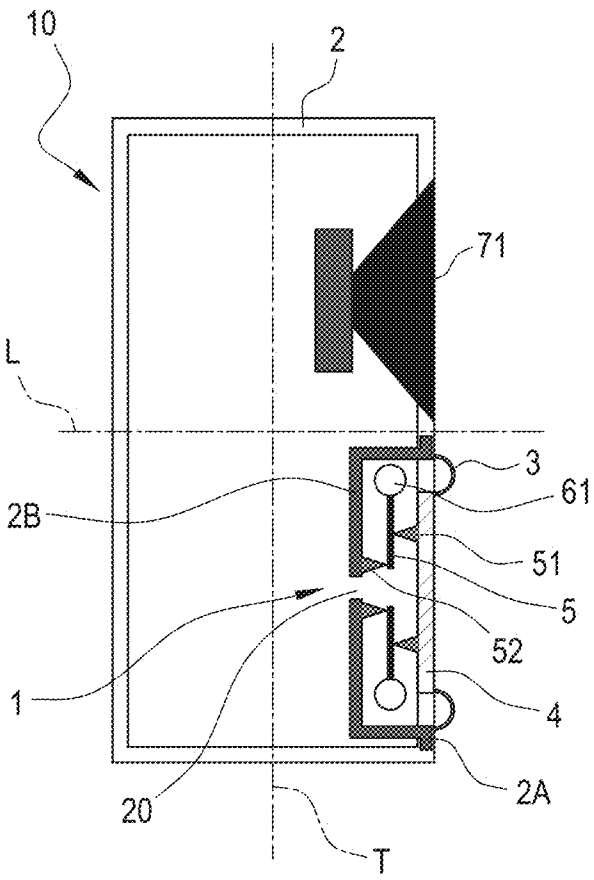
Figure 1D:
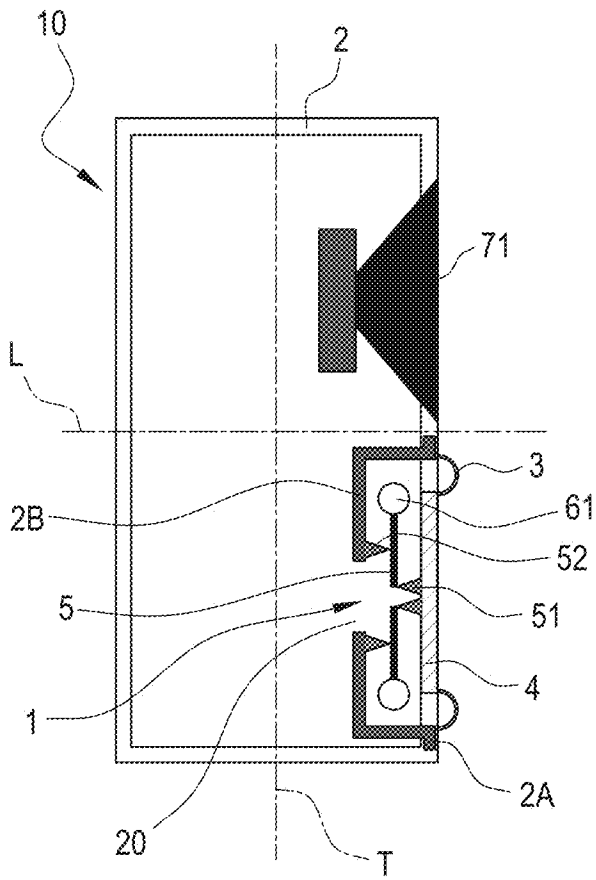
Figure 1G:
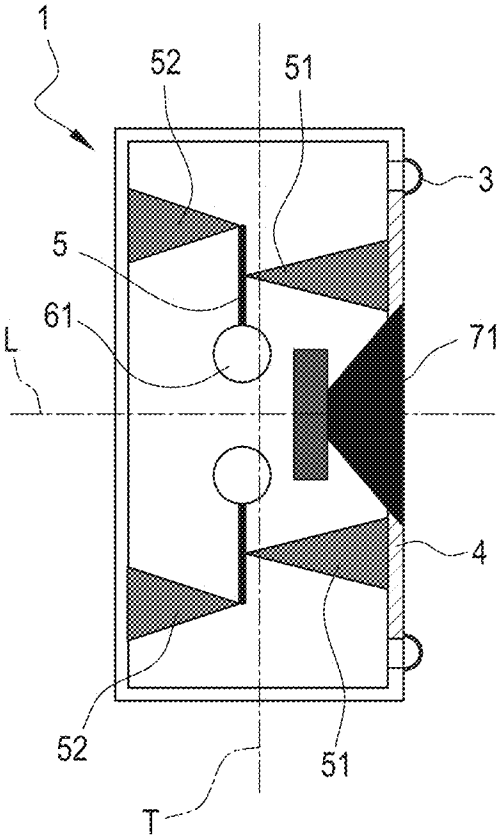
Figure 1F:
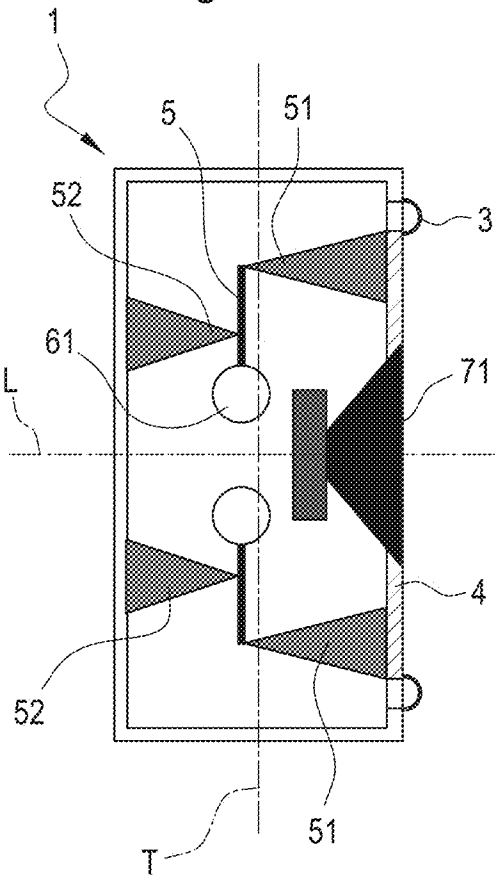
Figure 1I:
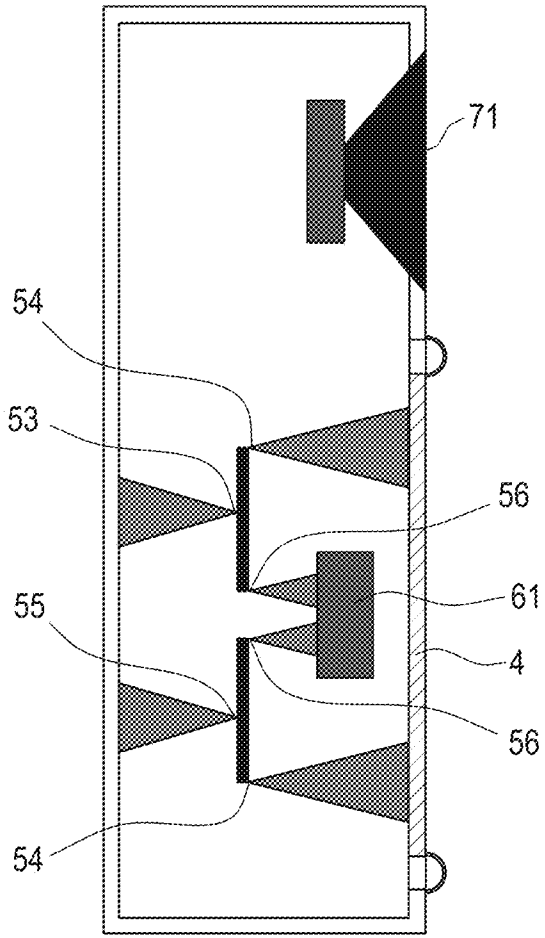
Figure 1H:
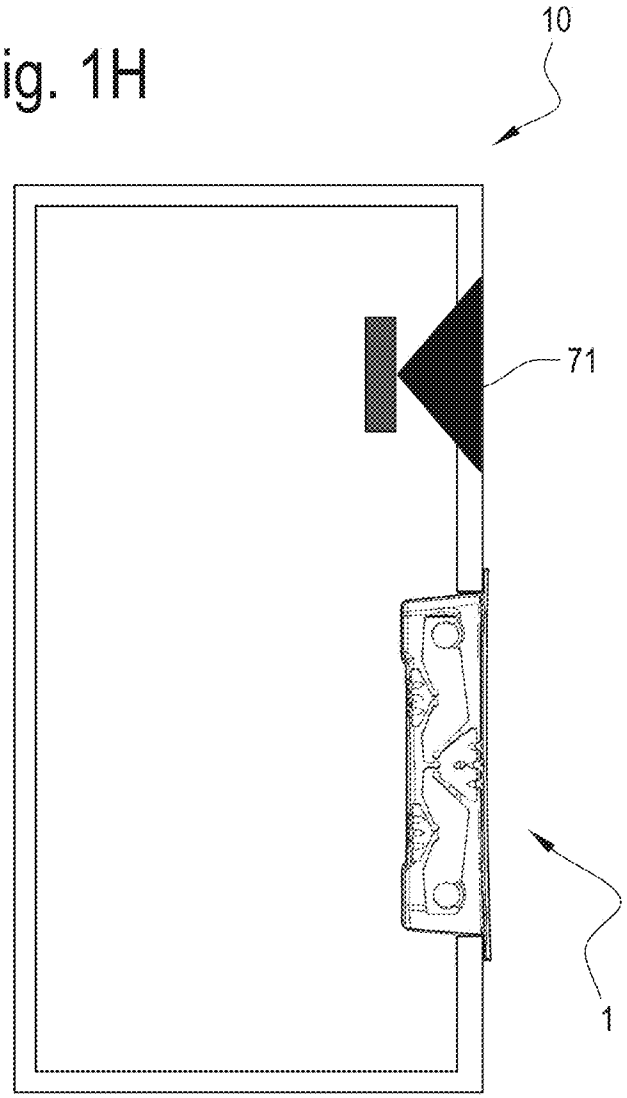
Figure 2:
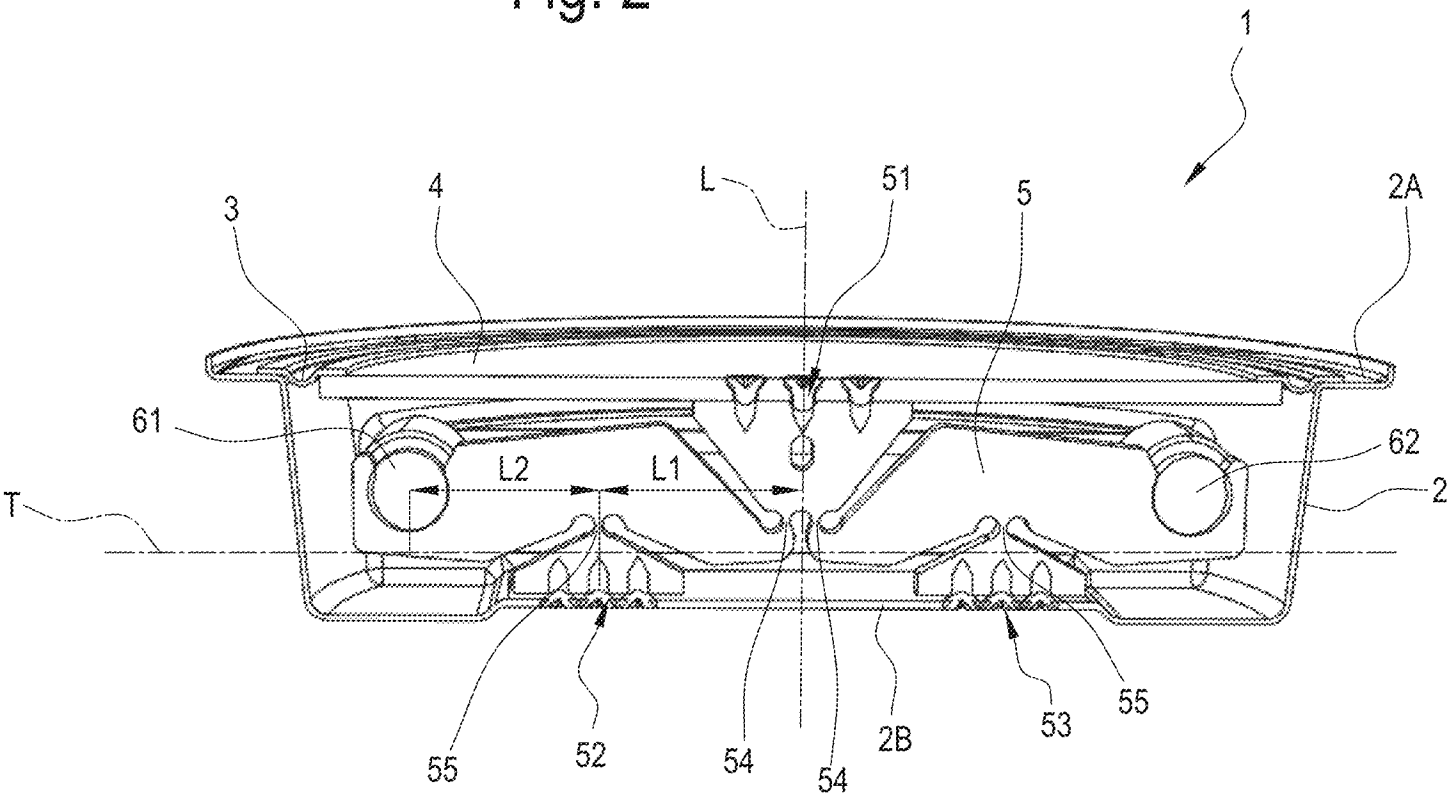
FIG. 2 shows a cross section of an acoustic device according to this disclosure, installable in a loudspeaker cabinet (if necessary, instead of a passive radiator of conventional, unbalanced type)
Figure 3:
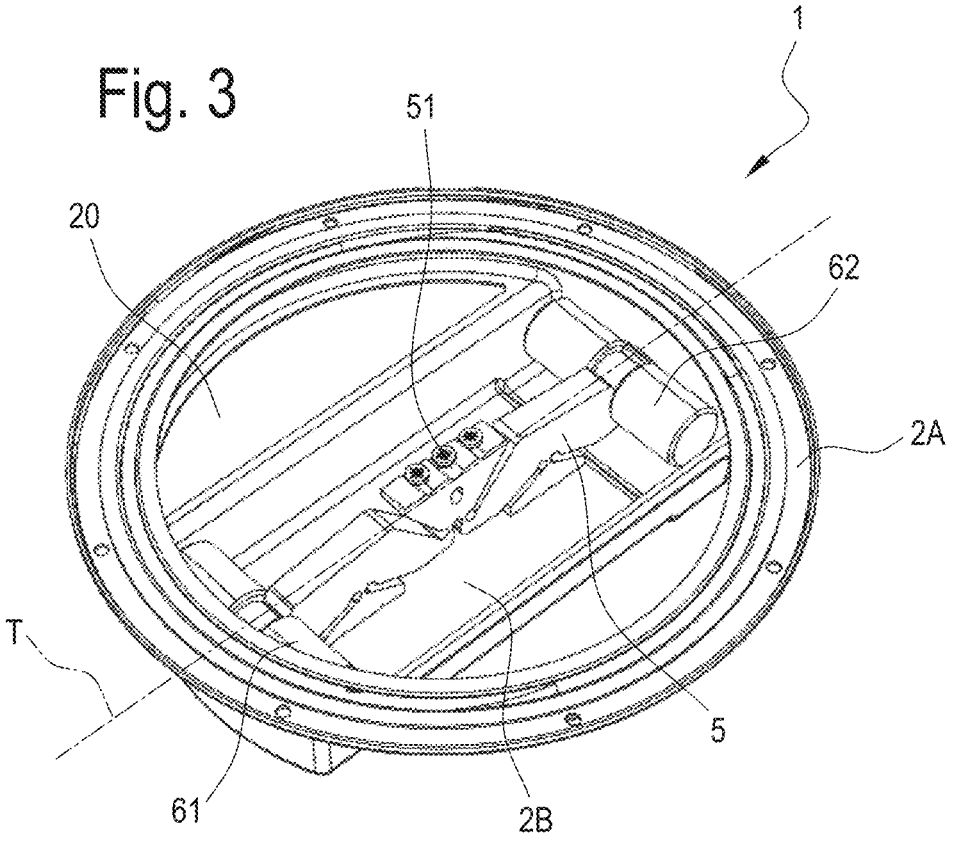
FIG. 3 illustrates a part of the acoustic device of FIG. 2, with the radiator hidden.
Figure 4:
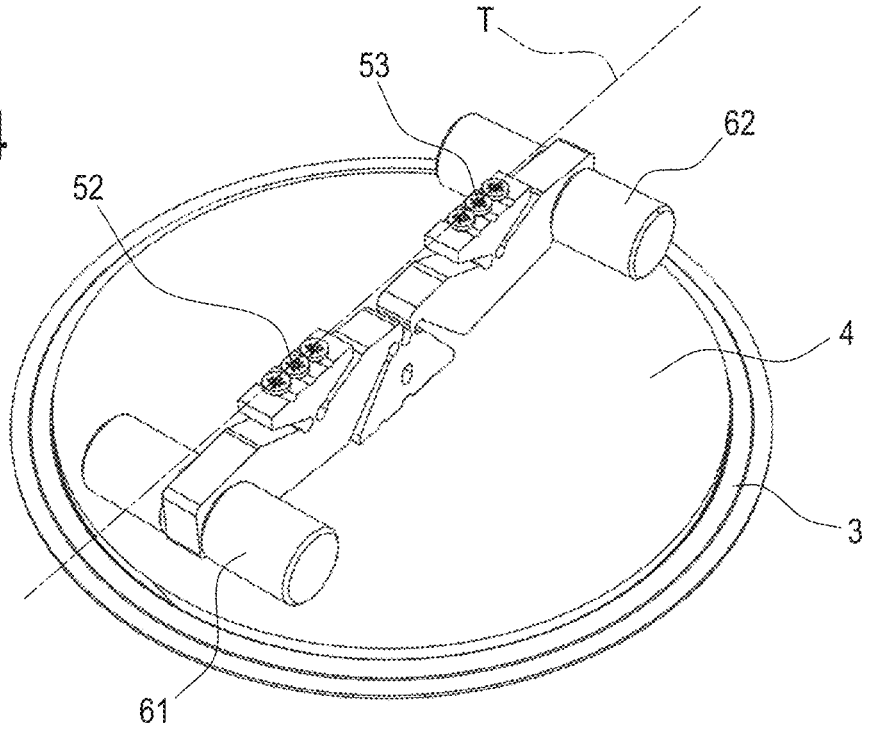
FIG. 4 illustrates a part of the acoustic device of FIG. 2, with the structure hidden, the structure being the part which (thanks to the flanged mounting) transmits the constraining forces to the cabinet in which the device is operatively mounted.
Figure 5:
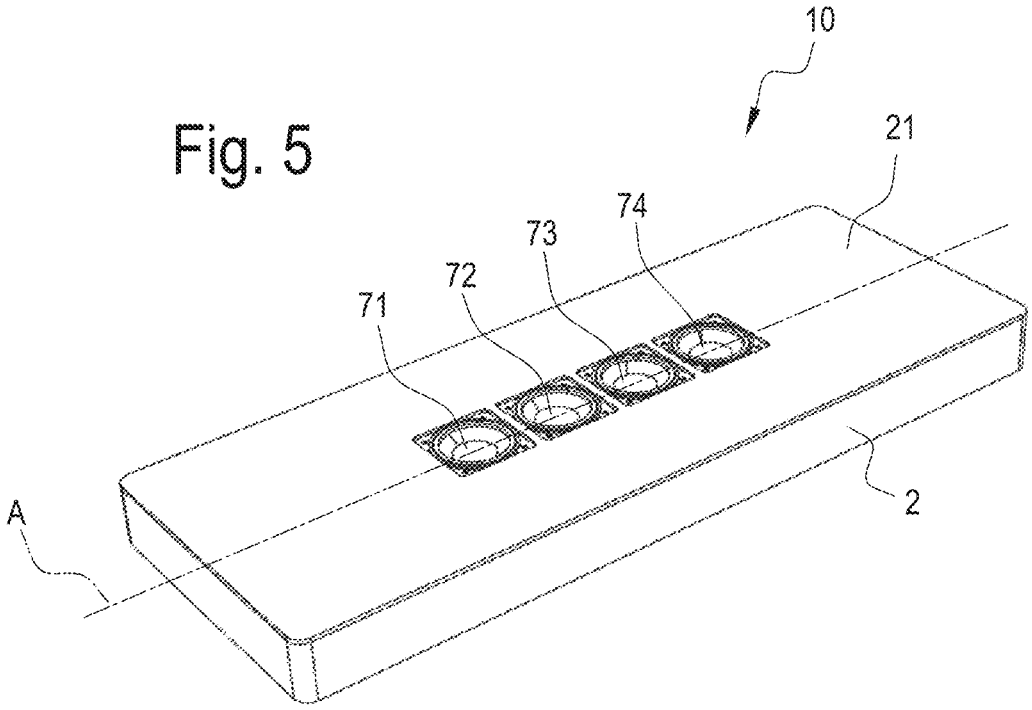
FIG. 5 illustrates a cabinet comprising a plurality of loudspeakers and an acoustic device according to this disclosure.
Figure 6:
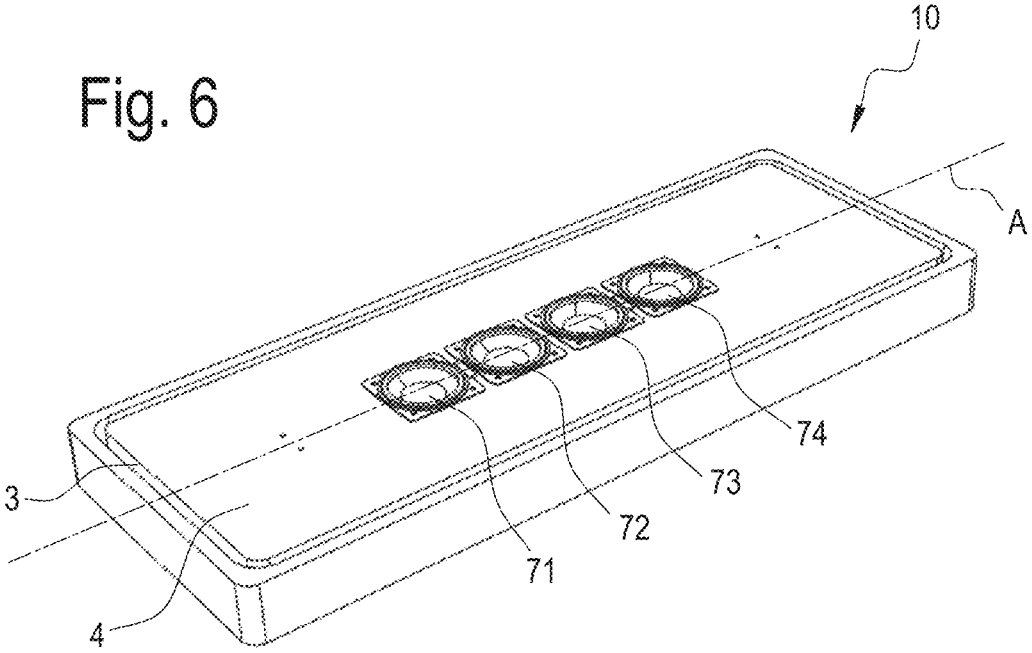
FIG. 6 illustrates the cabinet of FIG. 5, with some parts removed.
Figure 7:
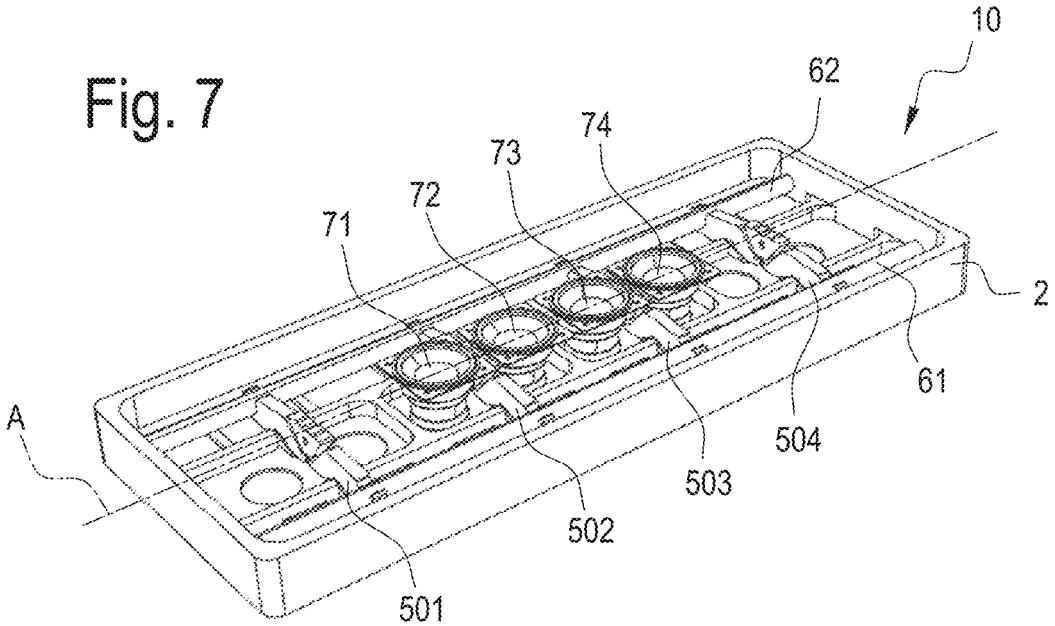
FIG. 7 illustrates the cabinet of FIG. 6, where the movable front part has also been removed.
Figure 8:
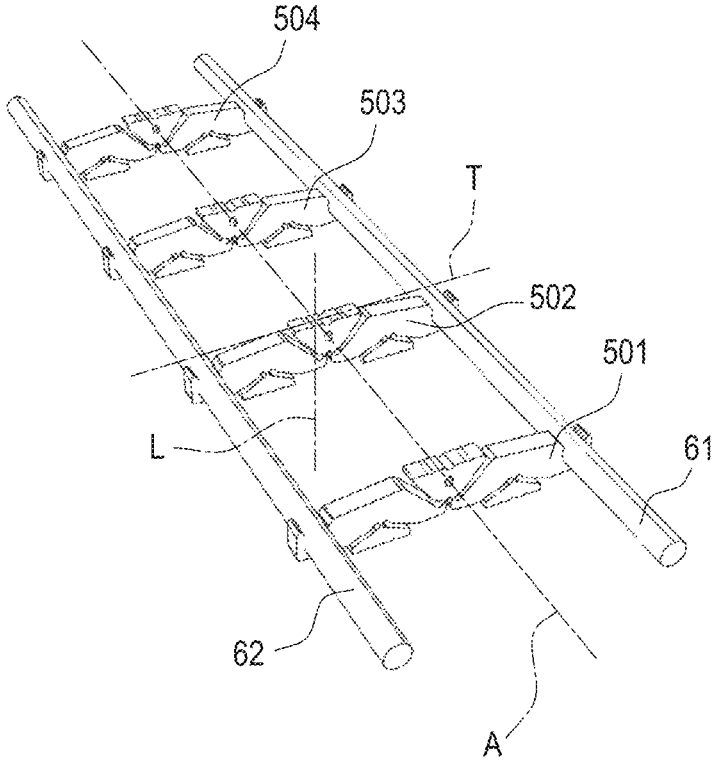
FIG. 8 illustrates a first and a second mass and a plurality of structures of the cabinet of FIG. 5.
Figure 9:
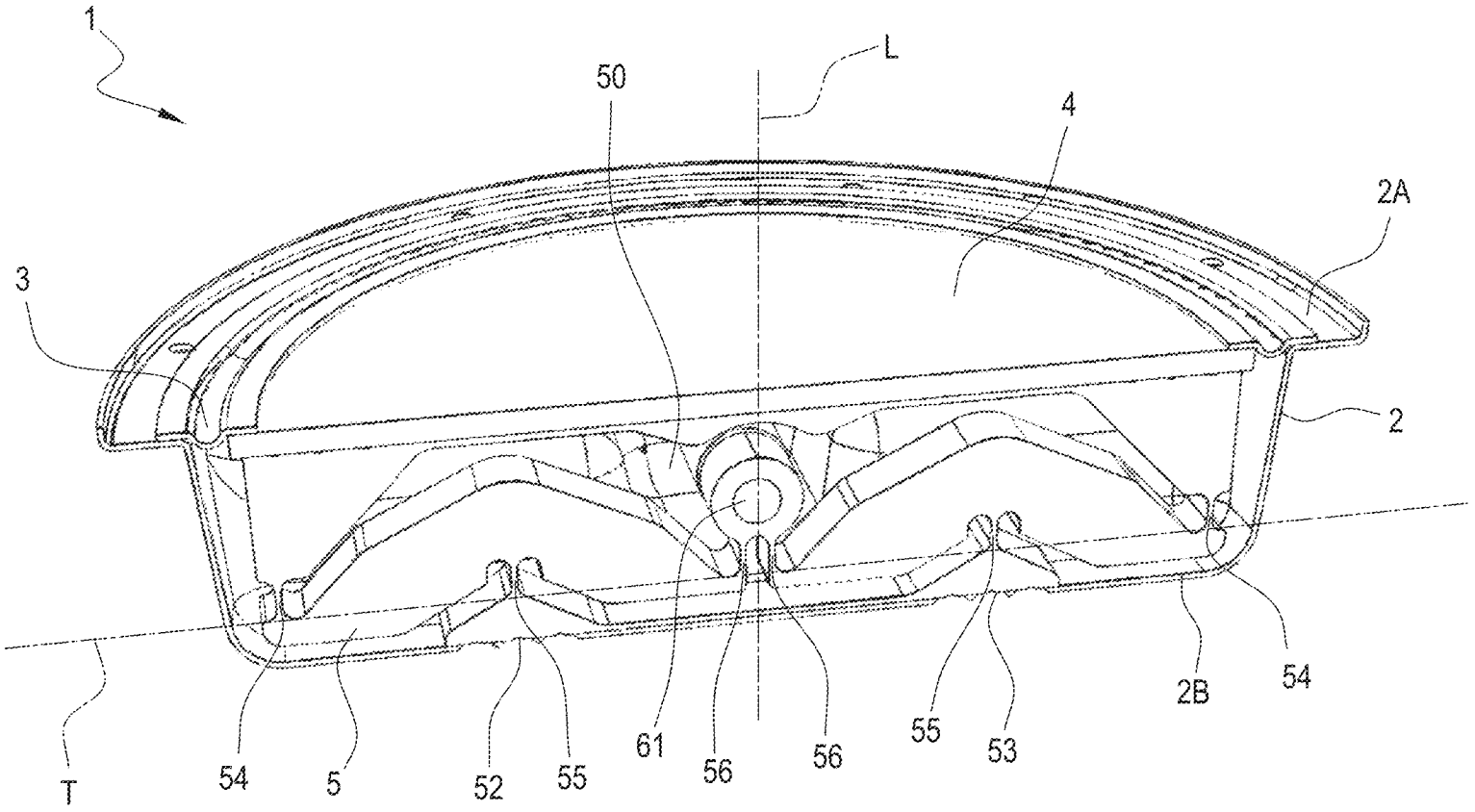
FIG. 9 shows a cross section of an acoustic device according to a further embodiment of this invention.
Figure 10:
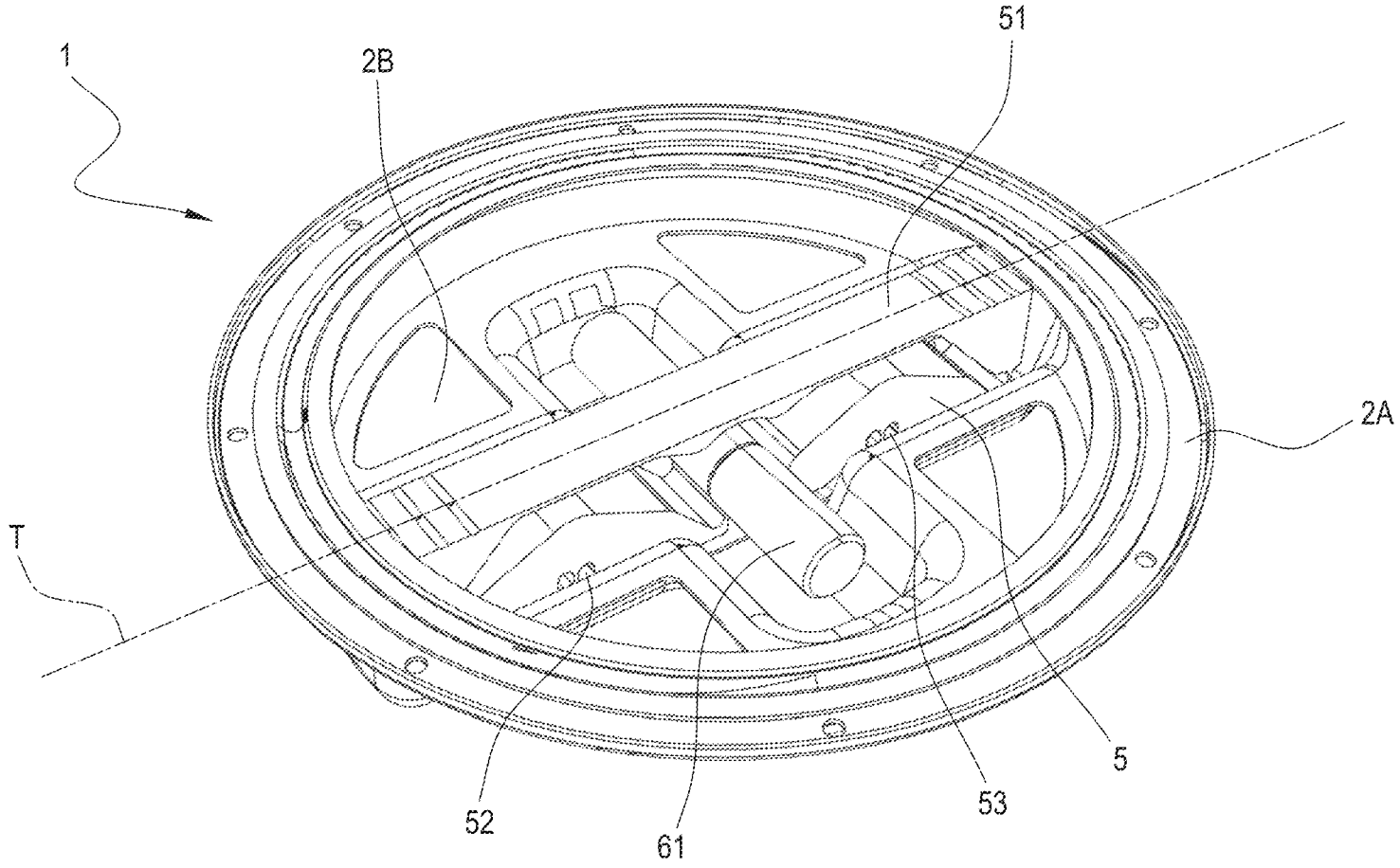
FIG. 10 illustrates a part of the acoustic device of FIG. 9, with the radiator hidden.
Figure 11:
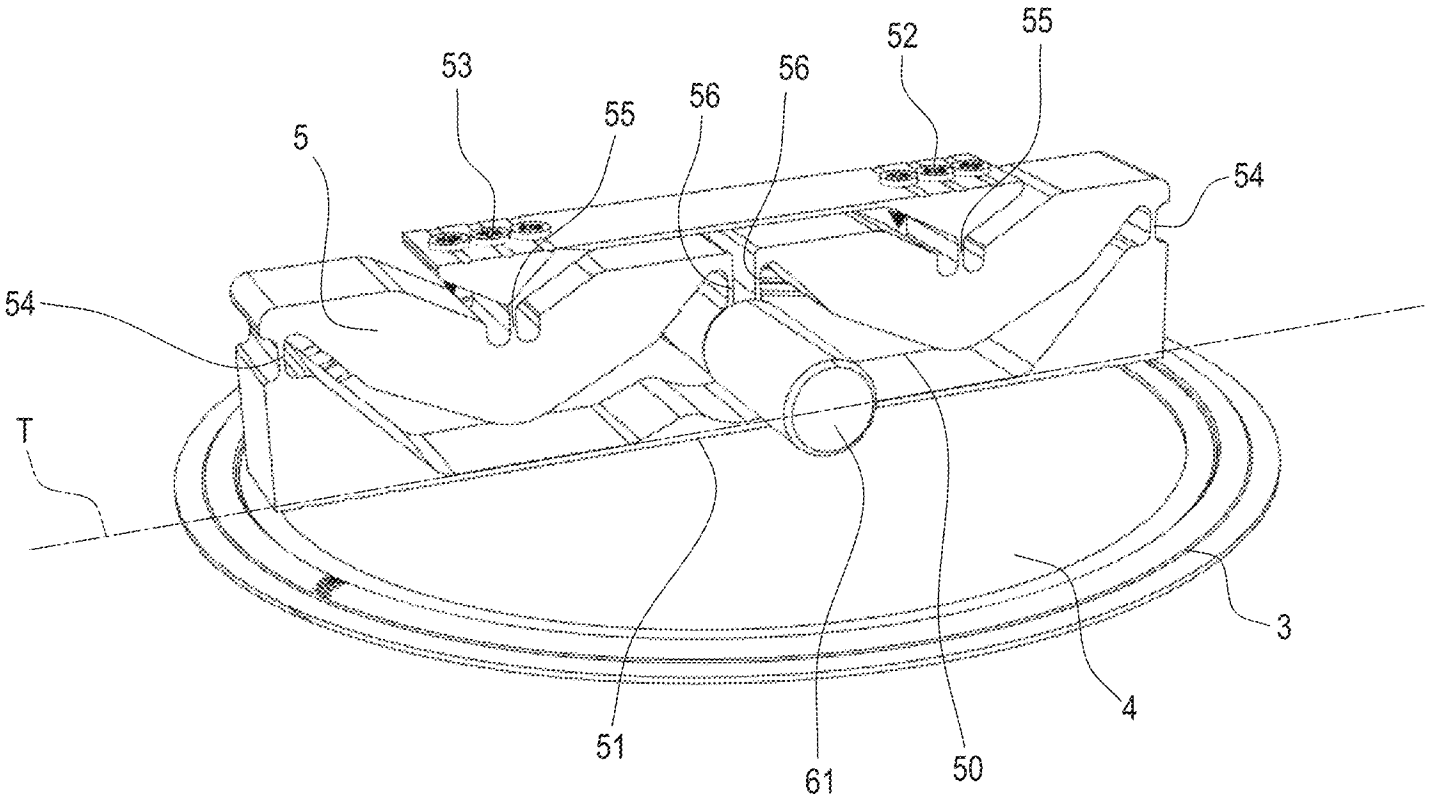
FIG. 11 illustrates a part of the acoustic device of FIG. 9, with the structure hidden, the structure being the part which (thanks to the flanged mounting) transmits the constraining forces to the cabinet in which the device is operatively mounted.

In an embodiment, the acoustic device 1 comprises a system for balancing the movement of the radiator 4, so as to minimize the displacement of the centre of mass of the acoustic device 1 caused by the vibration of the radiator 4, thereby also minimizing the vibration transmitted from the radiator 4 to the container. The system for balancing the movement of the radiator 4 is illustrated schematically in FIGS. 1A and 1B. In an embodiment, the acoustic device 1 comprises a system for unbalancing the movement of the radiator 4, so as to maximize the displacement of the centre of mass of the acoustic device 1 caused by the vibration of the radiator 4, thereby also maximizing the vibration transmitted from the radiator 4 to the container. The system for unbalancing the movement of the radiator 4 is illustrated schematically in FIG. 1C.

The acoustic device 1 comprises a structure 5 that extends along a transverse direction T, transverse (perpendicular) to the longitudinal direction L. The structure 5 is connected to the radiator 4 at a first connecting point 51 and to the container 2 at a second connecting point 52. The second connecting point 52 is located on the second side 2B of the container 2. The first connecting point 51 is spaced from the second connecting point 52 along the transverse direction T. It should be noted that the first connecting point 51 is located on a first longitudinal side of the structure 5, and the second connecting point 52 is located on a second longitudinal side of the structure 5, opposite the first longitudinal side. The structure 5 or a part of it can move with rotational or rototranslational motion relative to the radiator 4 and container 2; more specifically, the structure 5 may be flexible so it can move relative to the radiator 4 and container 2. Thus, the structure 5 works like a lever.

The device 1 comprises at least a first mass 61 connected to the structure 5. The mass 61 is aligned with the first connecting point 51 and the second connecting point 52 along the transverse direction T.

In the embodiment in which the structure 5 is used to balance the movement of the vibrating radiator 4, the second connecting point 52 is interposed, along the transverse direction T, between the first mass 61 and the first connecting point 51. Thus, moving the radiator 4 along the longitudinal direction L towards the second connecting point 52, that is to say, towards the second side 2B of the container 2, causes the first mass 61 to move away from the second side of the container 2, that is to say, towards the radiator 4.

In an embodiment, the distance L1 along the transverse direction T between the first connecting point 51 and the second connecting point 52 is equal to the distance L2 along the transverse direction T between the second connecting point 52 and the first mass 61, and the first mass 61 has a mass (or weight) that is equal to that of the radiator 4. In another embodiment, the distance L1 along the transverse direction T between the first connecting point 51 and the second connecting point 52 is less than the distance L2 along the transverse direction T between the second connecting point 52 and the first mass 61, and the first mass 61 has a mass (or weight) that is less than that of the radiator 4. In another embodiment, the distance L1 along the transverse direction T between the first connecting point 51 and the second connecting point 52 is greater than the distance L2 along the transverse direction T between the second connecting point 52 and the first mass 61, and the first mass 61 has a mass (or weight) that is greater than that of the radiator 4.

It should be noted that the structure 5 performs the function of lever: the portion of the structure 5 of length L1, between the first connecting point 51 and the second connecting point 52, perform the function of a first lever arm; the portion of the structure 5 of length L2, between the first connecting point 51 and the second connecting point 52, performs the function of a second lever arm, and the second connecting point 52 performs the function of fulcrum. A motive force is applied on the first lever arm due to the effect of the movement of the radiator 4, and a resistant force is applied on the second lever arm due to the effect of the mass 61. In the case where a second mass 62 and a third connecting point 53 are provided, the structure 5 performs the function of double lever: a first lever has the second connecting point 52 as its fulcrum and a second lever has the third connecting point 53 as its fulcrum.

In the embodiment in which the structure 5 is used to unbalance the movement of the radiator 4, the first connecting point 51 is interposed between the first mass 61 and the second connecting point 52. A distance L3 between the first connecting point 51 and the second connecting point 52 may be greater or smaller than a distance L4 between the first connecting point 51 and the first mass 61, depending on how much the vibration of the container 2 needs to be amplified. In this embodiment, moving the radiator 4 along the longitudinal direction L towards the second connecting point 52, that is to say, towards the second side 2B of the container 2, causes the first mass 61 to move towards the second connecting point 52, that is to say, towards the second side 2B of the container 2, that is to say away from the radiator 4.

In one example, the device 1 comprises at least a first mass 61 and a second mass 62, both connected to the structure 5.

In one example, the structure 5 has a third connecting point 53 that connects it to the container 2. The third connecting point 53 is aligned with the first and the second connecting point 51, 52 along the transverse direction T.

In the embodiment in which the structure 5 is used to balance the movement of the radiator 4, the first connecting point 51 is interposed, along the transverse direction T, between the second connecting point and the third connecting point 53. The third connecting point 53 is located on the same side of the structure 5, that is, its second longitudinal side, as the second connecting point 52. The distance L1 between the first connecting point 51 and the second connecting point 52 is equal to the distance between the first connecting point 51 and the third connecting point 53; the distance L2 between the second connecting point 52 and the first mass 61 is equal to the distance between the third connecting point 53 and the second mass 62. The distance L1 may be equal to the distance L2 and the first mass 61 and the second mass 62 may each have a mass (or weight) that is half the mass (or weight) of the radiator 4. Alternatively, the distance L1 may be less than the distance L2 and the first mass 61 and the second mass 62 may each have a mass (or weight) that is less than half the mass (or weight) of the radiator 4. Alternatively, the distance L1 may be greater than the distance L2 and the first mass 61 and the second mass 62 may each have a mass (or weight) that is greater than half the mass (or weight) of the vibrating radiator 4.

In an embodiment, the structure 5 is a flexible, elastic structure. The structure 5 is fixed to the second side 2B of the container at the second and the third connecting point 53; the structure 5 is also fixed to the radiator 4 at the first connecting point 51. The structure 5, responsive to a movement of the radiator 4 towards the second side 2B of the container 2, flexes and thereby displaces the first and second masses 61 and 62 towards the radiator 4. That way, the displacement of the mass of the radiator 4 is counteracted by the displacement of the first and second masses 61 and 62 and the centre of mass of the device 1 remains unchanged. Since the structure 5 is elastic, it will then tend to displace the radiator 4 away from the second side 2B of the container 2 (to its original position) and to displace the first and second masses 61 and 62 away from the radiator 4 (to their original positions). Thus, the structure 5 also performs a function of relieving the suspension 3 in that it contributes to returning the radiator 4 to its original position; the suspension 3 can thus be more flexible.

In an embodiment, the acoustic device 1 does not include a loudspeaker and is configured to be associated with a loudspeaker or a cabinet outside of the device. In this context, the container 2 might be provided with openings 20 which can put the space inside the container 2 operatively in communication with the space inside a loudspeaker or a cabinet. The openings 20 are preferably made on the second side 2B of the container. The acoustic device is thus associable with a loudspeaker or a cabinet.

It should be noted that the structure 5 includes parts that are in relative motion, connected to each other at articulation points. These articulation points constitute joints that allow these parts of the structure to move relative to each other, performing relative movements that include translational movements relative to each other; in addition to relative rotation, the articulation points preferably also allow translational movements. Thus, the articulation points constitute points (or zones) of constraint, where the parts of the structure are connected in such a way that they can move relative to each other.

More specifically, the structure 5 includes first articulation points 54 (or one first articulation point 54) and second articulation points 55 (or one second articulation point 55). The first articulation points 54 are connected (directly) to the first connecting points (or zones) 51 and allow the first connecting points 51 to rotate relative to the rest of the structure 5. The second articulation points 55 are connected (directly) to the second connecting points (or zones) 52 (or to the third connecting points 53) and allow the second (or the third) connecting points 52 to rotate relative to the rest of the structure 5. Thus, starting from the radiator 4 and going towards the masses 61, the second articulation points 55 are located downstream of the first articulation points 54.

It should be noted that, in another embodiment, the structure 5 may also comprise third articulation points 56. The third articulation points 56 are connected (directly or indirectly) to the masses 61 and allow the masses 61 to perform a (further) rotation relative to the rest of the structure 5. Thus, starting from the radiator 4 and going towards the masses 61, the third articulation points 56 are located downstream of the second articulation points 55; the third articulation points 56 are interposed between the second articulation points 55 and the masses 61.

The addition of the third articulation points 56 allows the masses 61 to move solely in translation (and preferably axial-symmetrically relative to the passive radiator 4 to be balanced) responsive to the translational (oscillatory) movement of the radiator 4, through a double rotation of the structure 5. Hence, in at least an example, the structure 5 comprises first articulation points 54, second articulation points 55 and third articulation points 56, spaced from one another and kinematically interposed between the radiator 4 and the one or more masses 61, 62, so that the one or more masses 61, 62 undergo a purely translational movement, responsive to the movement of the radiator 4, the (vibrational) movement of the radiator being a translation movement in its turn.

In an example of this embodiment, the device 1 comprises a single mass 61 connected to the structure 5, preferably at a position lying on an axis of symmetry of the radiator 4.

In this embodiment, too, the structure 5 may comprise a compliant mechanism. In this example embodiment (with compliant mechanism and first, second and third articulation points), the structure 5 has a first connecting point (or zone) 51 that is connected (for example, glued) to the radiator 4. This connecting point (or zone) 51 preferably extends in the transverse direction. In this embodiment, the structure 5 is also connected to the container 2 (specifically, to the second side 2B thereof) at a pair of connecting points 52 and 53. The connecting points 52 and 53 are aligned with each other along the transverse direction T. The mass 61 is interposed between the connecting points 52 and 53 along the transverse direction T; preferably, the mass 61 is equidistant from the connecting points 52 and 53. Preferably, the mass 61 extends perpendicularly to the longitudinal direction L and to the transverse direction T. The third connecting point 53 is located on the same side of the structure 5, that is, its second longitudinal side, as the second connecting point 52; the second longitudinal side is opposite the first side 2A that is connected to the radiator 4. Preferably, between its longitudinal side 2A, which is connected to the radiator 4, and its second longitudinal side, the structure 5 has an opening 50 which makes the structure 5 more elastic.

In this embodiment, the mass 61 moves with substantially linear (rectilinear) motion along the longitudinal direction L in axially (mirror) symmetric fashion relative to the radiator 4. This reduces unwanted harmonic components and improves the balancing effect.

In an embodiment, the acoustic device 1 includes at least one loudspeaker 71. More specifically, the acoustic device 1 may be integrated in a cabinet 10. The cabinet 10 comprises a plurality of loudspeakers 71, 72, 73, 74.

The loudspeakers 71, 72, 73, 74 are mounted on the radiator 4 of the passive resonator; more specifically, the radiator 4 is surrounded by the suspension 3 connected to the container 2 and includes a plurality of openings in which the loudspeakers 71, 72, 73, 74 are inserted. That way, the loudspeakers 71, 72, 73 74 are movable as one with the radiator 4. A cover 21, fixed to the container 2, may be provided above the radiator 4. The cover 21 constitutes an elastic suspension element allowing the radiator 4 and the loudspeakers 71, 72, 73, 74 to move relative to the container 2.

In this embodiment, the cabinet 10, that is, the acoustic device 1, may comprise a plurality of structures 501, 502, 503, 504. Each structure 501, 502, 503, 504 has a respective first connecting point, where it is connected to the radiator 4, and respective second and third connecting points, where it is connected to the second side 2B of the container 2. The structures 501, 502, 503, 504 are disposed in succession along a direction of succession A, perpendicular to the longitudinal direction L and to the transverse direction T. The cabinet 10 extends along the direction of succession A. The first and the second mass 61, 62 may extend along the direction of succession A to be connected to the structures 501, 502, 503, 504 of the plurality. That way, the structures 501, 502, 503, 504 are connected to each other through the first and the second mass 61 and 62.

What is claimed is:

1. An acoustic device, comprising:

a container;

a passive resonator, including a suspension connected to the container and a radiator connected to the suspension, wherein the suspension is configured to allow the radiator to oscillate relative to the container by translational movement along a longitudinal direction;

a structure having first connecting points, where it is connected to the radiator, and second connecting points, where it is connected to the container, the structure being movable alternately between a first position and a second position, responsive to a vibration of the radiator; and one or more masses, spaced from the radiator and associated with the structure, so that a movement of the structure between the first position and the second position causes a corresponding movement of the one or more masses;

wherein the structure includes first articulation points positioned at the first connecting points that articulate the structure to the container;

second articulation points positioned at the second connecting points that articulate the structure to the one or more masses; and third articulation points that articulate the one or more masses to the structure.

2. The acoustic device according to claim 1, wherein the structure is elastically deformable from the first to the second position, responsive to a force applied by the radiator and, in the absence of forces applied by the radiator, is positioned at the first position.

3. The acoustic device according to claim 2, wherein the structure is made at least partly of a deformable elastic material.

4. The acoustic device according to claim 3, wherein the structure includes a compliant mechanism.

5. The acoustic device according to claim 1, wherein, responsive to a movement of the structure between the first position and the second position, at least a portion of the structure is movable with a roto-translational movement about the first and/or the second connecting point.

6. The acoustic device according to claim 1, comprising a first mass and a second mass, wherein the structure has a third connecting point, where it is connected to the container, wherein the first mass and the second mass are disposed symmetrically about the axis along which the radiator moves.

7. The acoustic device according to claim 1, wherein either of the following conditions is verified:

(i) the structure is configured to move from the first position to the second position in response to a movement of the radiator towards the second connecting point, thereby causing a movement of the one or more masses towards the radiator; or (ii) the structure is configured to move from the first position to the second position in response to a movement of the radiator towards the second connecting point, thereby causing a movement of the one or more masses away from the radiator.

8. The acoustic device according to claim 1, wherein the container has a first side, where the suspension is connected, and a second side, opposite to the first side, wherein the second connecting point is on the second side and wherein the second side is without passive resonators.

9. The acoustic device according to claim 1, wherein the container defines an internal space and the structure is positioned in the internal space.

10. The acoustic device according to claim 1, wherein the container defines an internal space and the device further comprises a loudspeaker, wherein at least part of the loudspeaker is positioned inside the internal space.

11. The acoustic device according to claim 10, wherein the loudspeaker is connected to the radiator of the passive resonator and is movable together with the radiator.

12. The acoustic device according to claim 1, wherein the radiator is movable along a longitudinal axis and the one or more masses are movable the same longitudinal axis or axes parallel to the longitudinal axis, and wherein the structure is configured for generating, responsive to a translational movement of the radiator, a purely translational movement of one or more mases, in opposite direction with respect to the movement of the radiator.

13. The acoustic device according to claim 12, wherein either of the following conditions is verified:

(i) a single mass is provided, that mass moving along the longitudinal axis;

(ii) two or more masses are provided, the two or more masses moving along respective axes which are parallel to the longitudinal axis and are arranged according to an axial symmetry with respect to the longitudinal axis.

14. The acoustic device according to claim 1, wherein the passive resonator has a circular shape, and the acoustic device is rotary symmetric with respect to a longitudinal axis.

15. An acoustic device, comprising:

a container;

a passive resonator, including a suspension connected to the container and a radiator developing around a longitudinal axis and connected to the suspension, so that the radiator oscillates relative to the container along the longitudinal axis;

a mass, located inside the container along the longitudinal axis, spaced from the radiator;

a structure connected to the radiator and to the mass, the structure being movable to allow a reciprocate relative movement of the radiator and the mass along the longitudinal axis, so that, responsive to a translational movement of the radiator, the mass simultaneously undergoes a pure translation along the longitudinal axis, in opposite direction with respect to the translation of the radiator.

16. A method for extending the low frequency response of a loudspeaker, comprising:

providing an acoustic device comprising a container defining an internal space, the loudspeaker, where at least part of the loudspeaker is positioned inside the internal space, and a passive resonator, including a suspension connected to the container and a radiator connected to the suspension to rock relative to the container, by alternative translational movement along a longitudinal direction; and transmitting movement from the radiator to one or more masses positioned inside the internal space;

wherein the acoustic device further comprises a structure, the one or more masses being associated with the structure, the structure including first connecting points connecting the structure to the radiator;

second connecting points connecting the structure to the container;

first articulation points, positioned at the first connecting points, that articulate the structure to the container;

second articulation points, positioned at the second connecting points, that articulate the structure to the one or more masses, and third articulation points that articulate the one or more masses to the structure;

wherein the structure undergoes movements or deformations responsive to a vibration of the radiator, to counteract or amplify a mechanical vibration transmitted by the vibrating radiator to the container; and wherein the structure moves the one or more masses along the longitudinal direction so that, to a predetermined first translational movement of the radiator, a predetermined second translational movement of the one or more masses corresponds, contemporary and in the opposite direction.

17. The acoustic device according to claim 1, wherein, in a resting position of the radiator, the first connecting points are located at a greater distance from the radiator than the one or more masses, with respect to the longitudinal direction.

18. The acoustic device according to claim 14, wherein the one or more masses includes a central mass, located inside the container, aligned with the longitudinal axis and spaced from the radiator.

19. The acoustic device according to claim 1, wherein the second articulating points are radially interposed between the first articulating points and the third articulating points, with respect to a longitudinal axis, the radiator developing around the longitudinal axis.

20. The acoustic device according to claim 1, wherein each of the second articulating points is provided at a tip of a corresponding support element integral with the container, the support element having triangular or conical shape.

* * * * *